US006971906B2

(12) United States Patent
Yamaoka

(10) Patent No.: US 6,971,906 B2
(45) Date of Patent: Dec. 6, 2005

(54) CONNECTOR AND A CONNECTOR ASSEMBLY

(75) Inventor: Atsushi Yamaoka, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/031,022

(22) Filed: Jan. 7, 2005

(65) Prior Publication Data

US 2005/0153594 A1 Jul. 14, 2005

(30) Foreign Application Priority Data

Jan. 9, 2004 (JP) ..... 2004-004213

(51) Int. Cl.[7] ..... H01R 3/00

(52) U.S. Cl. ..... 439/489; 439/352

(58) Field of Search ..... 439/350, 352, 439/356, 357, 489

(56) References Cited

U.S. PATENT DOCUMENTS

| | | | | |
|---|---|---|---|---|
| 6,109,956 | A | 8/2000 | Kawase et al. | |
| 6,196,867 | B1 | 3/2001 | Kawase et al. | |
| 6,561,833 | B2 * | 5/2003 | Saka et al. | 439/352 |
| 6,644,996 | B2 * | 11/2003 | Yamashita | 439/352 |
| 6,722,913 | B2 * | 4/2004 | Saka et al. | 439/352 |

* cited by examiner

*Primary Examiner*—Thanh-Tam Le
(74) *Attorney, Agent, or Firm*—Gerald E. Hespos; Anthony J. Casella

(57) ABSTRACT

A housings (20) has a lock arm (30) that engages a mating housing (10) when the housings (10, 20) are connected completely. A cover (40) is mounted slidably on the housing (20) and is pushed rearward as the housings (10, 20) are being connected. The cover (40) is biased forward by springs (45) that have front ends connected releasably to the cover (40). The springs (45) separate the housings (10, 20) if the connecting operation is stopped too soon. However the springs (45) are released from the cover (40) and expand to an unbiased state when the connection is complete.

15 Claims, 15 Drawing Sheets

CONNECTOR AND A CONNECTOR ASSEMBLY

BACKGROUND OF THE INVENTION

1. Field of the Invention

The invention relates to a connector with a partial connection detecting function.

2. Description of the Related Art

U.S. Pat. No. 6,109,956 and U.S. Pat. No. 6,196,867 disclose a connector with a partial connection detecting function. These connectors have male and female housings that are connectable with one another. A compression coil spring is mounted in the female housing so that backward movement of the rear end of the spring is prevented. The male housing pushes the front end of the spring backward in the process of connecting the housings. As a result, the spring contracts resiliently and accumulates a biasing force.

The rear end of the spring is freed and moves back when the two housings are connected properly and locked together. Thus, the biasing force is released and the spring elongates backward. On the other hand, the accumulated biasing force of the spring separates the housings if the connecting operation is stopped before the two housings are connected properly, thereby providing an indication of an incomplete connection.

A receptacle of the male housing or a rib on the outer surface of the receptacle engages and presses the front end of the spring in the process of connecting the two housings. Thus, the above construction cannot be applied to male housings that have a short receptacle or receptacles that cannot have a rib because the biasing spring cannot be pressed. There has been a demand to use a spring to detect partial connection on such connectors.

The invention was developed in view of the above problem and an object is to improve overall operability of the connection and/or separation.

SUMMARY OF THE INVENTION

The invention relates to a connector with a housing that is connectable with a mating housing. A lock arm is provided on the housing and is resiliently engageable with a lock projection on the mating housing. A slider and at least one biasing means are provided in the housing. The slider is slidable substantially along forward and backward directions and the biasing means is extendible and compressible substantially along forward and backward directions. The biasing means has a rear end fixed to the housing and a front end that is locked temporarily at a position receded from the front of the slider. The temporarily locked state can be canceled by a resilient force acting when the biasing member is resiliently compressed to a specified extent or more. The front end of the slider contacts a pushing portion at a position on the mating housing behind the lock projection to push the front end in a connected state before the lock arm engages the lock projection.

The front end of the slider contacts the pushing portion of the housing before the lock arm engages the lock projection. The pushing portion pushes the slider as the connecting operation continues. The rear end of the biasing means is fixed to the housing and the front end is locked temporarily by the slider. Thus, the biasing means is compressed resiliently as the slider is pushed. During this time, the lock arm is engaged with the lock projection and passes the lock projection while being resiliently displaced. The lock arm returns to engage the lock projection when the two housings are connected properly. Thus, the two housings are locked in their properly connected state. The biasing means is compressed resiliently to at least a specified extent. Thus, the resilient force cancels the temporarily locked state and the biasing means is freed from the resiliently compressed state while the front end of the biasing means extends substantially towards the front end of the slider.

The resilient force of the compressed biasing means separates the housings if the connecting operation is stopped before the housings are connected properly. As a result, partial connection can be detected.

The front end of the slider is extended forward and the pushing portion for pushing the slider is behind the lock projection. Thus, the slider is pushed to compress the biasing means before the lock arm and the lock projection engage. Therefore, a partial connection detecting function using the biasing means is exhibited securely even in connectors have a short receptacle and cannot have a pushing rib on the outer surface of a housing.

The slider preferably includes a locking means for locking the front end of the biasing means that has returned to its free state.

The front end of the biasing means is locked by the locking means of the slider when the two housings are connected properly to return the biasing means to its free state. This prevents the biasing means from unnecessarily making loose movements.

The lock arm preferably is seesaw-shaped. The front end of the lock arm is engageable with the lock projection, while the rear end thereof is operable to disengage the front end of the lock arm from the lock projection. The rear end of the biasing means is fixed to the rear end of the lock arm.

The biasing means is deformed resiliently to accumulate the resilient force and curves when the slider is pushed with the lock arm that has been displaced pivotally by the engagement with the lock projection. The biasing means is mounted in a pivoting space for the lock arm. Thus, a mounting space for the biasing member spring is saved to enable a compact housing.

The slider preferably has an unlocking portion for pressing the rear end of the lock arm. Thus, the lock arm is displaced pivotally to free the lock projection from the locked state when the slider is moved back sufficiently for the two housings to be connected properly with each other.

The biasing means is compressed gradually and accumulates a biasing force when the slider is moved back sufficiently to connect the two housings properly. The unlocking portion presses the rear end of the lock arm to displace or rock the lock arm pivotally when the slider is moved back by the specified distance. Thus, the locked state of the lock projection is canceled and the biasing force of the biasing means separates the housings.

The pushing portion preferably is on part of a surface passing the center of the one housing and extending substantially along a connecting direction of the two housings so that the part intersects with a surface passing the lock projection. Thus, the outer shape of the one housing in a direction extending along the surface passing the lock projection can be smaller.

The slider preferably has an accommodating chamber in which a movable member is accommodated. The front end of the biasing means is mounted to the movable member.

Locking means preferably can lock the movable member temporarily to the slider in two spaced apart positions.

The biasing means preferably comprises two biasing elements arranged substantially symmetrically with respect to the slider.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to the invention is illustrated in FIGS. 1 to 15. The connector has a male housing 10 and a female housing 20 that are connectable with each other along a connecting direction CD, as shown in FIG. 9. In the following description, ends of the housings 10, 20 to be connected with each other are referred to as the front.

Figure 1:
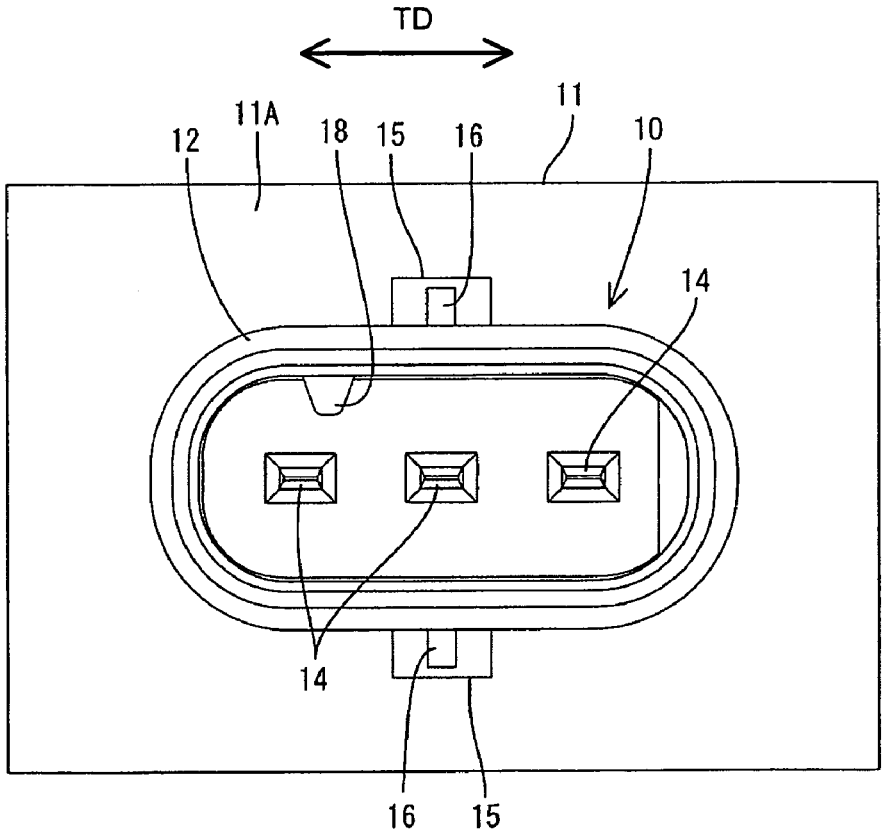
FIG. 1 is a front view of a male housing according to one embodiment of the invention.
Figure 8:
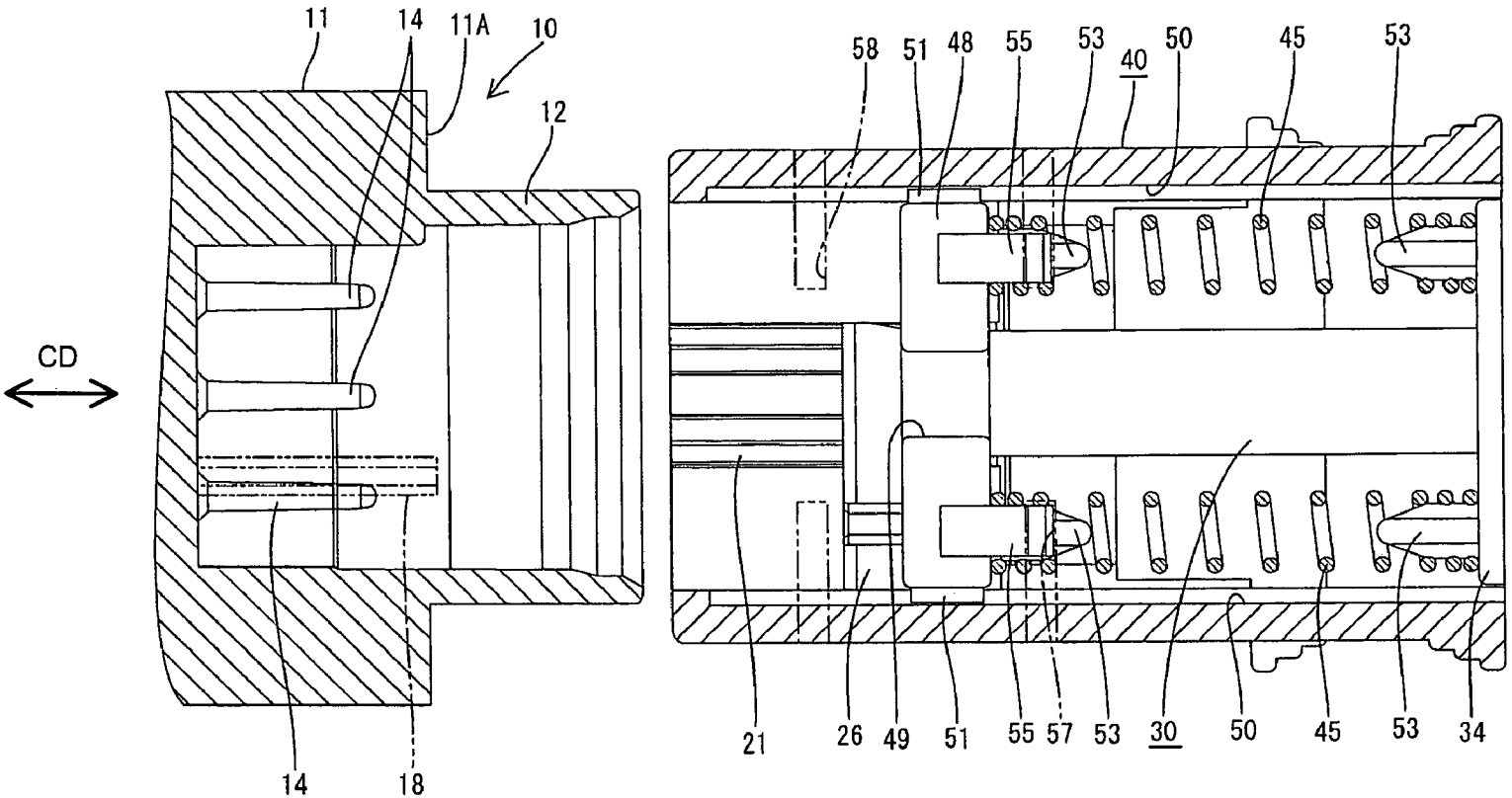
FIG. 8 is a plan view in section showing a state before the male and female housings are connected.
Figure 9:
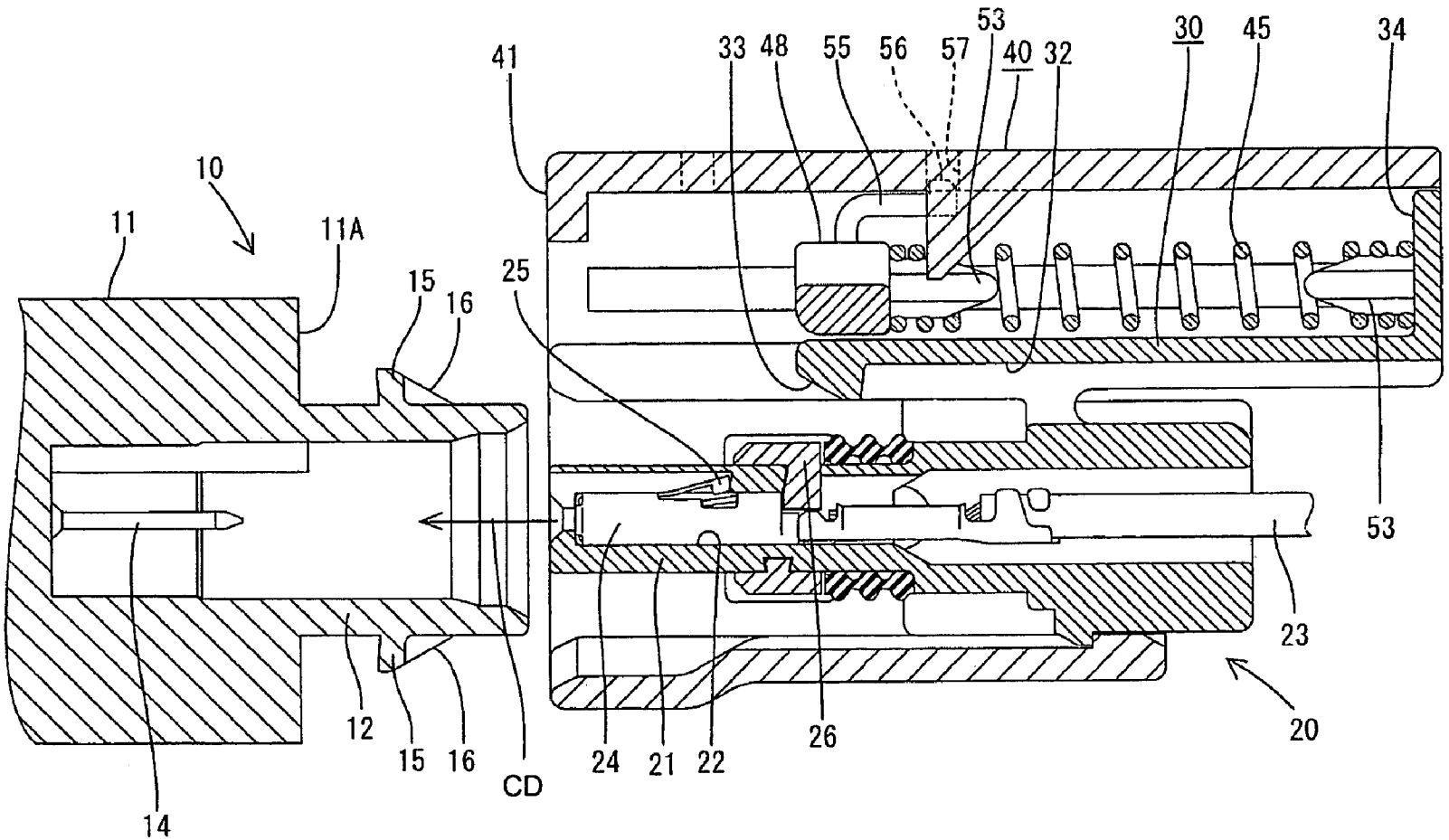
FIG. 9 is a longitudinal section showing the state before the male and female housings are connected.

The male housing 10 is made e.g. of a synthetic resin and has a receptacle 12 projecting integrally from a wall 11A of an apparatus 11 installed in a vehicle or the like, as shown in FIGS. 1, 8 and 9. The receptacle 12 is a tube with a elliptic front view, and the back surface is recessed in the apparatus 11. Thus, a projecting length of the receptacle 12 form the wall 11A is short. Three tab-shaped male terminals 14 project substantially side by side along a transverse direction TD from the back surface of the receptacle 12.

Two lock projections 15 project substantially symmetrically in the widthwise and longitudinal middle positions of the upper and lower surfaces of the receptacle 12. A guiding surface 16 is formed at the front of each lock projection 15 and slopes towards the back.

A connection detecting rib 18 projects at a back side of the ceiling surface of the male housing 10 receded from a position near the left end when viewed from front.

Figure 2:
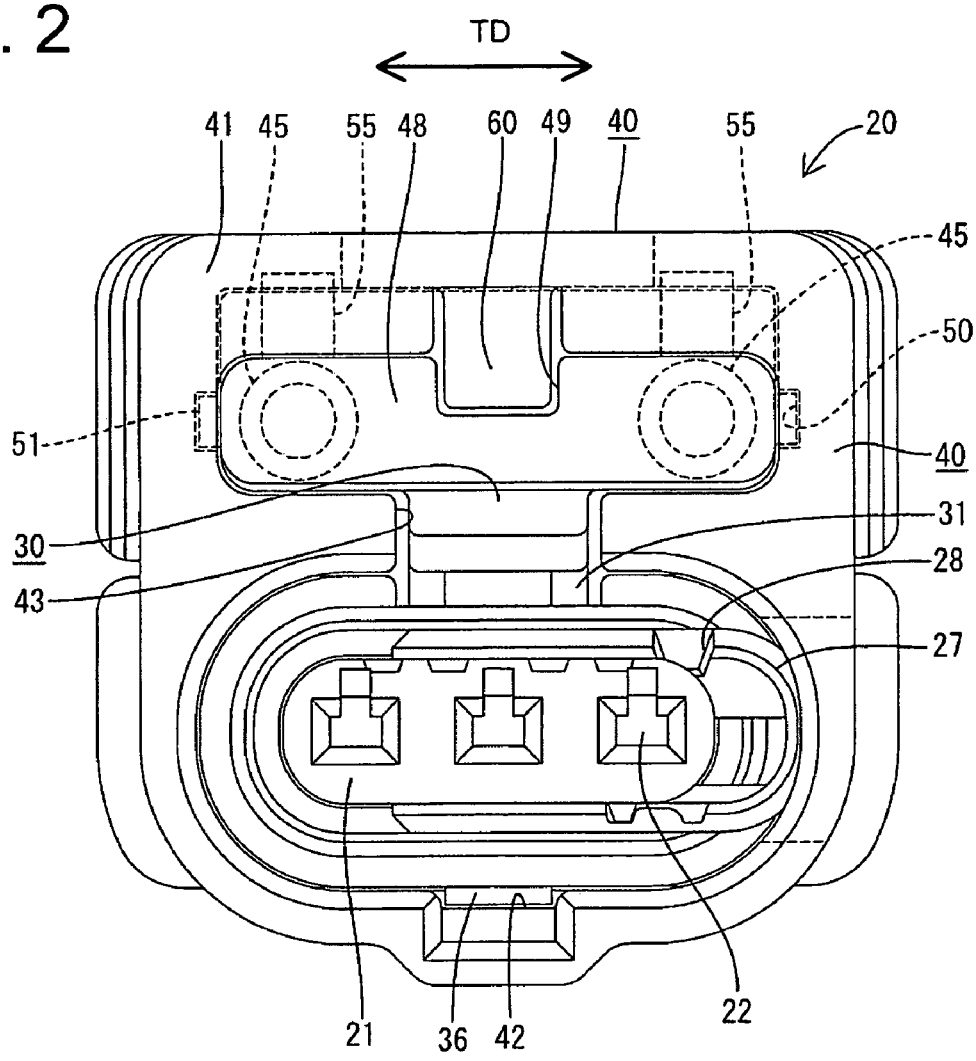
FIG. 2 is a front view of a female housing having a slide cover mounted thereon.
Figure 6:
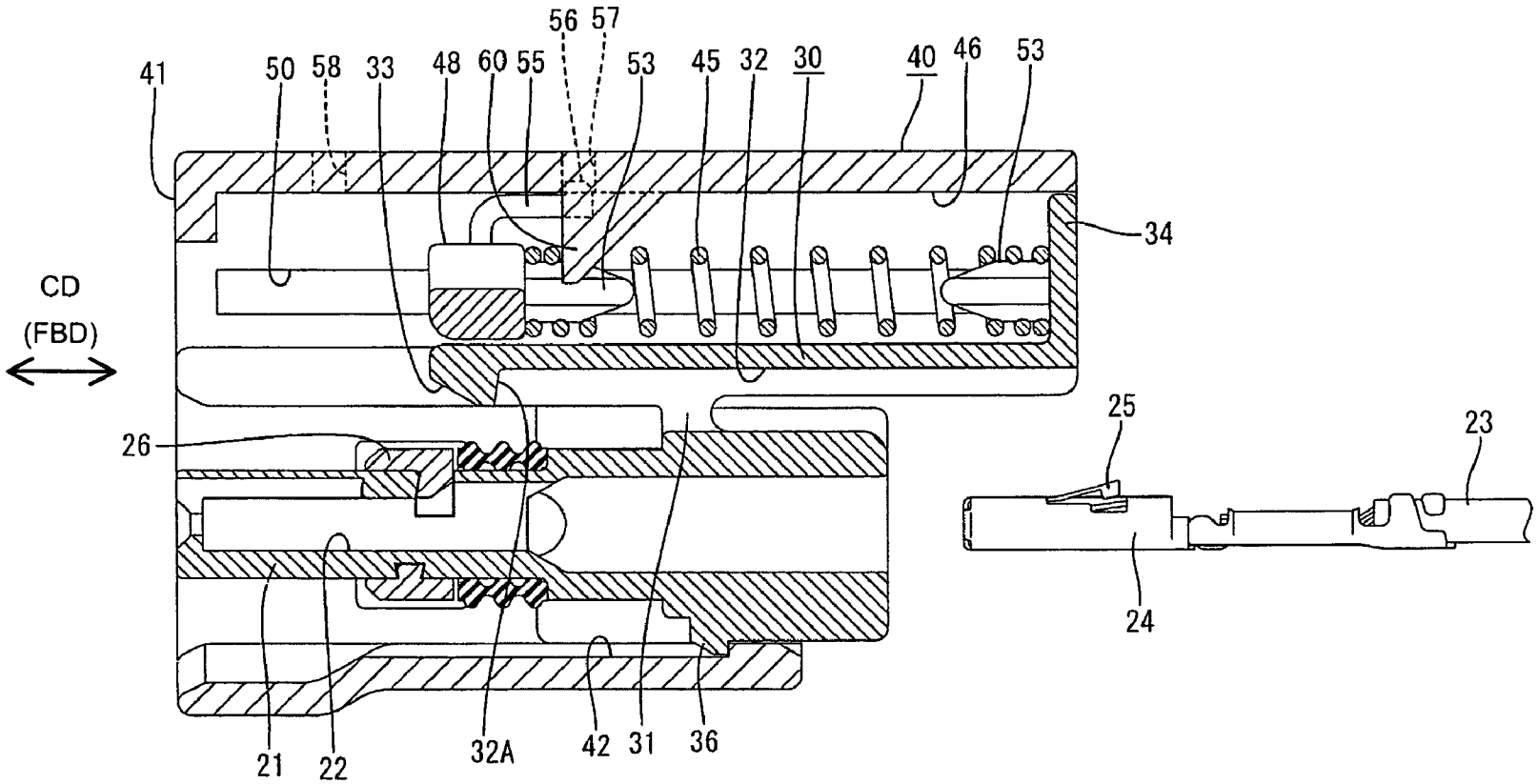
FIG. 6 is a longitudinal section showing a state before a female terminal is inserted into the female housing.
Figure 7:
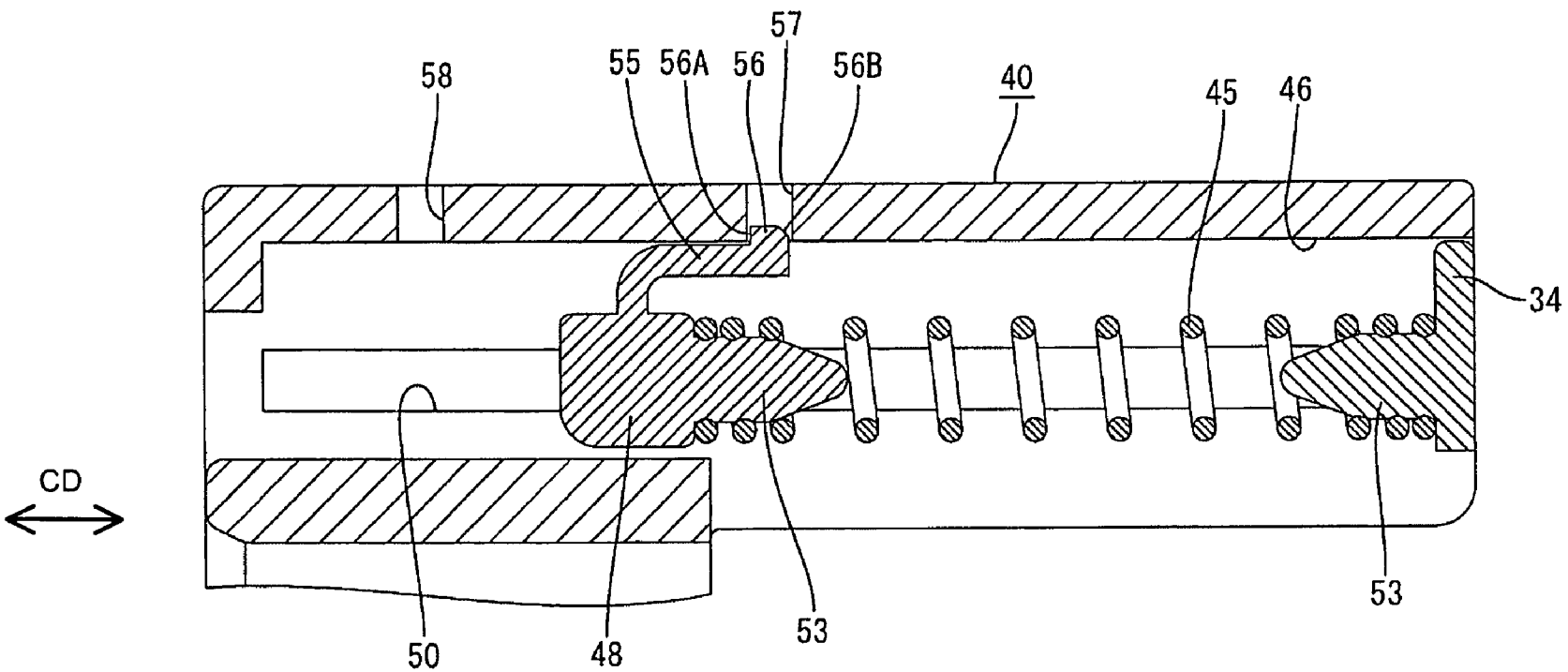
FIG. 7 is a partial section showing a mounting portion for a biasing spring.

The female housing 20 also is made e.g. of a synthetic resin and has a wide elliptic terminal accommodating portion 21, as shown in FIG. 2. About the front two-thirds of the terminal accommodating portion 21 is fittable into the male housing 10 (see FIG. 13). Three cavities 22 are formed in the terminal accommodating portion 21 and conform to the arrangement of the male terminals 14 in the male housing 10. As shown in FIG. 6, a female terminal 24 is secured to an end of a wire 23 and is inserted into each cavity 22. The female terminal 24 is locked first by a metal lock 25 and then is locked doubly by a side-type retainer 27. The retainer 27 has a detection groove 28 that faces the rib 18 of the male housing 10 and engages the rib 18 when the retainer 27 is pushed to a proper position.

A lock arm 30 is provided in a substantially widthwise center of the upper surface of the terminal accommodating portion 21 for locking the male and female housings 10, 20 in their properly connected state. The lock arm 30 is narrow and long in forward and backward directions and has a length substantially equal to the length of the terminal-accommodating portion 21. The front end of the lock arm 30 is near a mount position of the retainer 27 and the rear end of the lock arm 30 projects back from the rear surface of the terminal-accommodating portion 21. A support 31 extends down from the lower surface of the lock arm 30 at a position slightly before the longitudinal middle of the lock arm 30. The support 31 couples the lock arm 30 to the upper surface of the terminal-accommodating portion 21 at position about ⅓ of the entire length from the rear of the terminal-accommodating portion 21. The lock arm 30 can be displaced pivotally about the support 31 in a seesaw-like manner.

Figure 3:
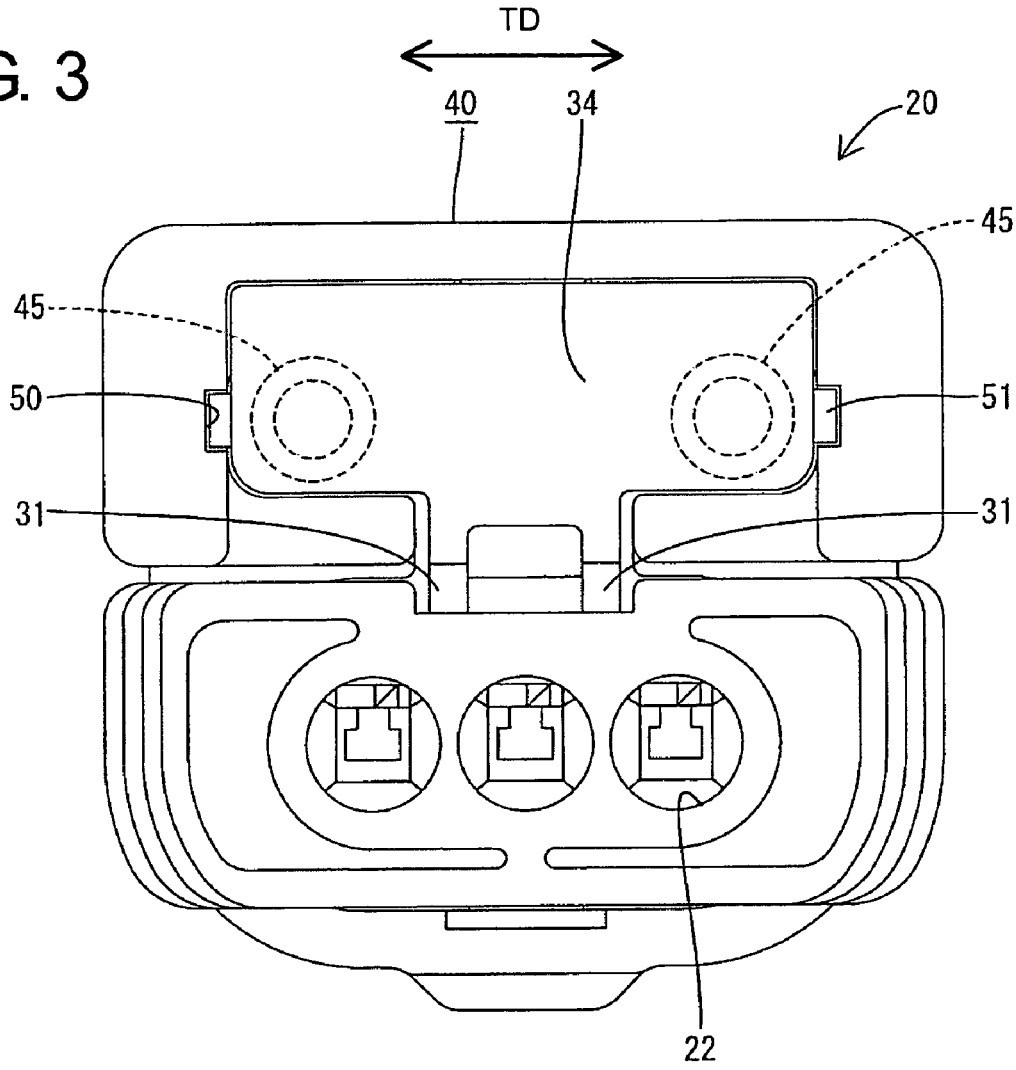
FIG. 3 is a rear view of the female housing having the slide cover mounted thereon.
Figure 4:
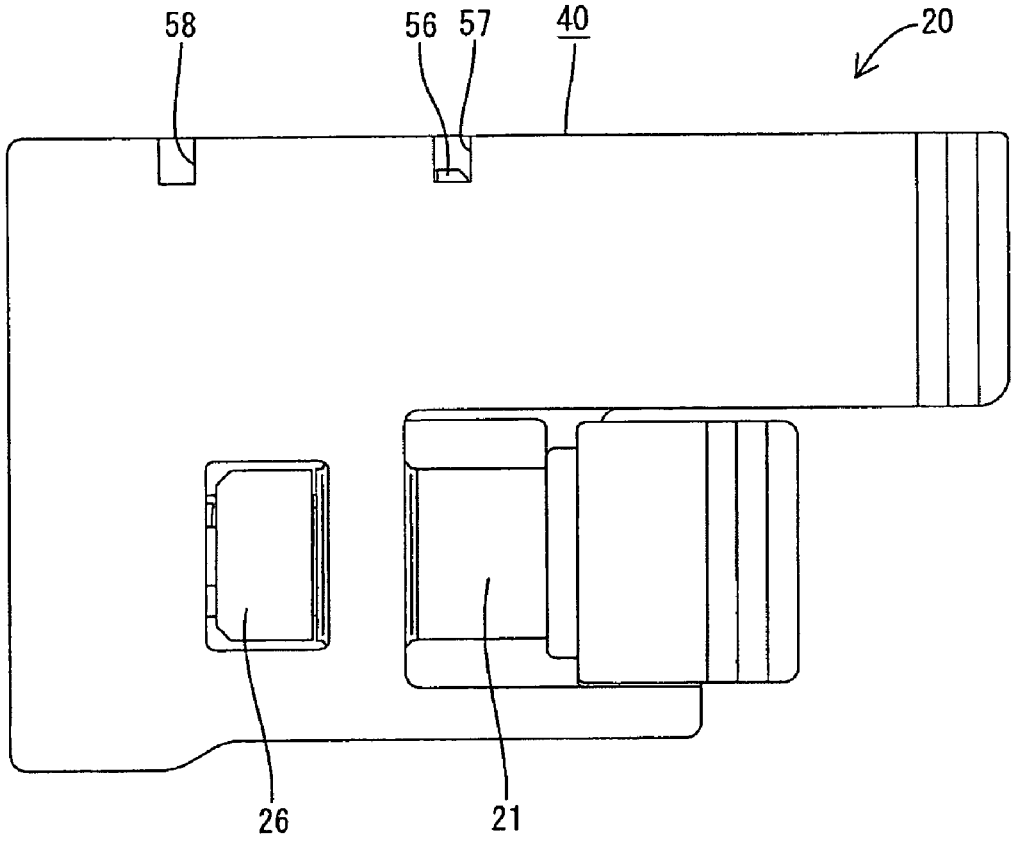
FIG. 4 is a side view of the female housing having the slide cover mounted thereon.
Figure 5:
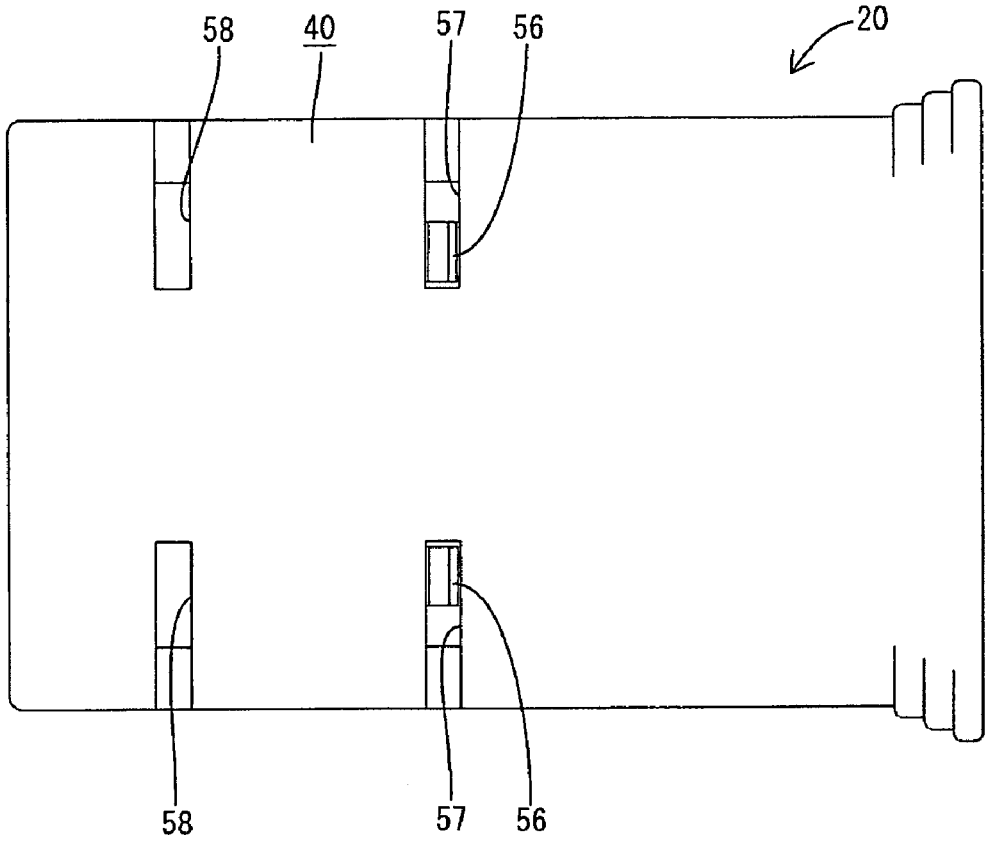
FIG. 5 is a plan view of the female housing having the slide cover mounted thereon.

A lock groove 32 is formed in the lower surface of the lock arm 30 and extends from the rear of the lock arm 30 to a position slightly receded from the front end of the lock arm 30. A front surface 32A of the lock groove 32 is engageable with the upper lock projection 15 of the male housing 10. A slanted guiding surface 33 is formed before the lock groove 32, and a wide operable plate 34 projects up at the rear end of the lock arm 30, as shown in FIG. 3.

The front end of the lock arm 30 moves onto the lock projection 15 and causes the lock arm 30 to displace pivotally. The lock projection 15 fits into the lock groove 32 and engages the front surface 32A to effect locking when the lock arm 30 passes the lock projection 15. The lock arm 30 then returns towards its initial posture. The operable plate 34 can be pressed down towards the female housing 20 to lift the front side of the lock arm 30 in this state. Thus, the lock projection 15 exits from the lock groove 32 to effect unlocking.

A slide cover 40 is made e.g. of a synthetic resin and is mounted on the female housing 20. The slide cover 40 is substantially a tube with a front plate 41, as shown in FIGS. 2 and 6. Portions of the slide cover 40 rearward of the front plate 41 surround the bottom surface of the terminal-accommodating portion 21, the opposite side surfaces of the front of the terminal-accommodating portion 21, the opposite side surfaces of the lock arm 30 and the upper surface of the lock arm 30. A guide groove 42 is formed in the inner bottom surface of the slide cover 40 and extends in forward and backward directions FBD. The slide cover 40 is mounted movably on the female housing 20 substantially along forward and backward directions FBD and substantially parallel to the connecting direction CD by slidably fitting a stopper 36 on the bottom surface of the terminal-accommodating portion 21 into the guide groove 42. The front plate 41 of the slide cover 40 has a window 43 that permits entry of the receptacle 12 and the lock projections 15 of the male housing 10, as shown in FIG. 2.

An accommodating chamber 46 is formed in an upper part in the slide cover 40 for accommodating two biasing springs 45 and the like. The biasing springs 45 may be compression coil springs, leaf springs, resilient (rubber) rods, or the like.

A wide movable member 48 is accommodated in the accommodating chamber 46 and extends over substantially the entire width of the accommodating chamber 46. As shown in FIG. 8, guide grooves 50 are formed in opposite side surfaces of the accommodating chamber 46. The guide grooves 50 have open rear ends and extend to positions slightly receded from the front edge. Slidable members 51 project from the opposite left and right side surfaces of the movable member 48 and fit slidably in the guide grooves 50 so that the movable member 48 is movable along forward and backward directions FBD in the accommodating chamber 46.

Spring mounts 53 project at opposite widthwise ends of the movable member 48 and the operable plate 34 of the lock arm 30 substantially facing each other so that the front and rear spring mounts 53 are paired. The front end of each spring 45 is pressed onto the spring mount 53 of the movable member 48 and the rear end thereof mounted onto the spring mount 53 of the operable plate 34 to fix each spring 45.

Resilient locks 55 project up from the opposite widthwise ends of the upper surface of the movable member 48 and then extend back. Locking sections 56 are formed at the leading ends of the respective resilient locks 55. Each locking section 56 has a vertically aligned locking surface 56A facing to the rear (left in FIG. 7) and a slanted surface 56B facing to the front (right in FIG. 7). The locking sections 56 fit in first locking holes 57 formed in the ceiling of the slide cover 40 at positions slightly before the longitudinal center.

The springs 45 initially are mounted in a substantially unbiased state between the movable member 48 and the operable plate 34 of the lock arm 30. Additionally, the locking sections 56 of the movable member 48 are fit in the first locking holes 57 of the slide cover 40 to hold the slide cover 40 temporarily at a position where backward movement is prevented. Simultaneously, the stopper 36 engages the rear end of the guide groove 42 to prevent forward movement of the slide cover 40. The front plate 41 is substantially flush with the front surface of the terminal-accommodating portion 21 in this condition.

The springs 45 can be compressed while the locking sections 56 of the resilient locks 55 are in the first locking holes 57. The compressed springs 45 create resilient restoring forces that cause the resilient locks 55 to curve inwardly. Thus, the slanted surfaces 56B permit the locking sections 56 to exit the first locking holes 57.

Second locking holes 58 are formed in the ceiling of the slide cover 40 forward of the first locking holes 57 and are configured to receive the locking sections 56 of the resilient locks 55. The locking sections 56 may be released the first locking holes 57. As a result, the resilient forces of the springs 56 will move the movable member 48 and the resilient locks 55 forward. The locking sections 56 then will fit into the second locking holes 58 when the springs 45 reach their unbiased state. At this time, the movable member 48 is in the window hole 43 of the front plate 41 of the slide cover 40.

A force of a specified intensity or higher may pull the movable member 48 back while the locking sections 56 of the resilient locks 55 are fit in the second locking holes 58. As a result, the springs 45 exert forces to deform the resilient locking pieces 55 inwardly. The slanted surfaces 56B then permit the locking sections 56 to exit from the second locking holes 58.

An unlocking portion 60 projects in the widthwise and longitudinal center of the ceiling of the slide cover 40 for pressing the operable plate 34 of the lock arm 30. A cam surface 61 is defined at the rear (right in FIG. 14) of the unlocking portion 60 and inclines forward toward the bottom end. The cam surface 61 contacts the upper end of the operable plate 34 when the slide cover 40 is moved back. Thus, the operable plate 34 is pressed down towards the female housing 20 and the lock arm 30 pivots to effect unlocking.

An escaping recess 49 is formed in the upper surface of the movable member 48 for permitting the passage of the unlocking portion 60.

The female housing 20 initially is in a state where the locking sections 56 of the resilient locks 55 of the movable member 48 are fit in the first locking holes 57. Additionally, the springs 45 are substantially in an unbiased or lightly compressed state between the movable member 48 and the operable plate 34 of the lock arm 30. The slide cover 40 is at an advanced position where the front plate 41 is substantially flush with the front surface of the terminal-accommodating portion 21 of the female housing 20, as shown in FIG. 9.

Figure 10:
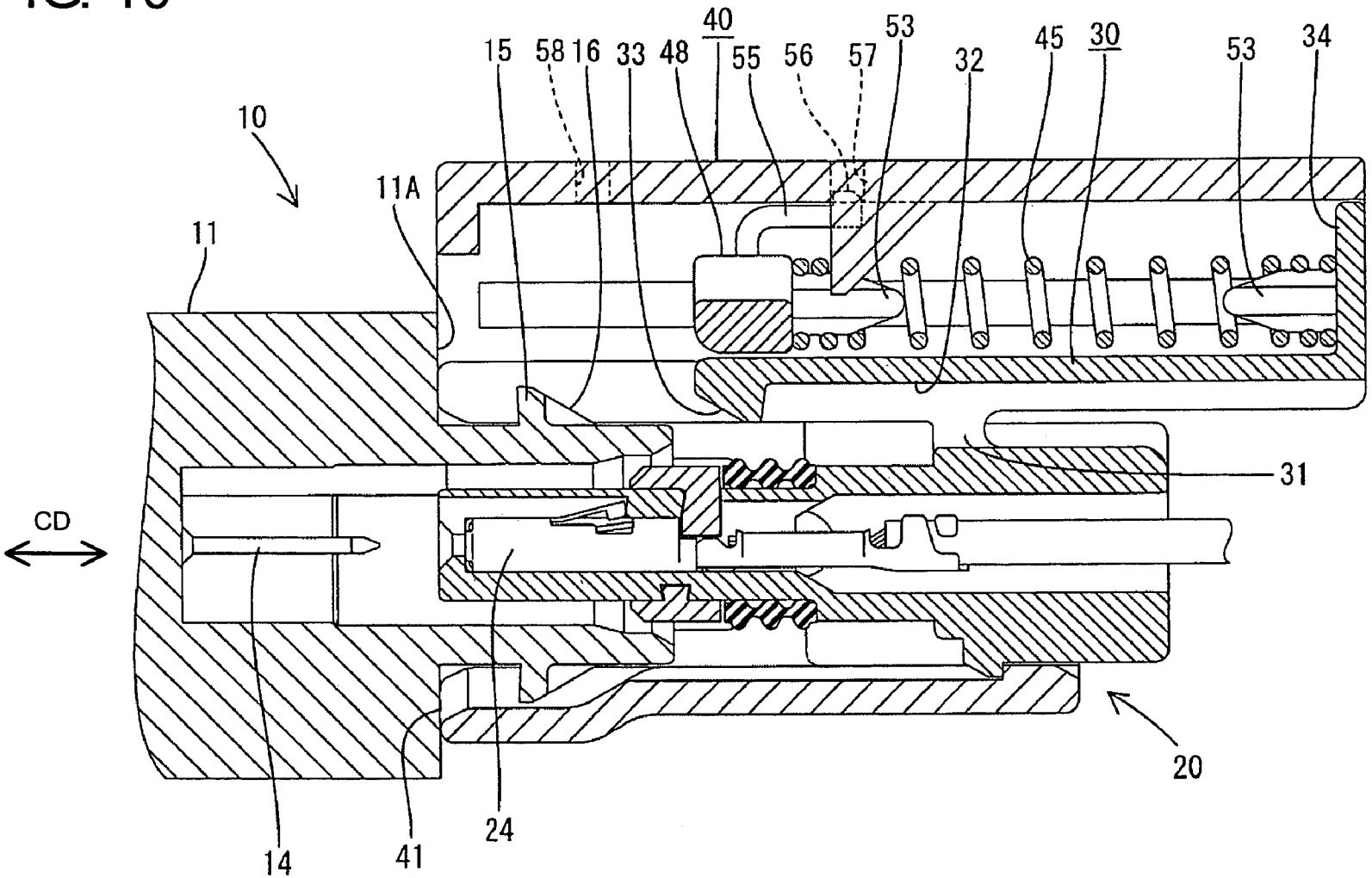
FIG. 10 is a longitudinal section showing a state where the pushing of the slide cover is started.

The female housing 20 then is connected in the connecting direction CD with the male housing 10, as shown by an arrow in FIG. 9. As a result, the receptacle 12 and the lock projections 15 of the male housing 10 enter the slide cover 40 from the front. The front plate 41 of the slide cover 40 contacts the wall surface 11A of the apparatus 11, as shown in FIG. 10, before the upper lock projection 15 engages the front end of the lock arm 30.

The slide cover 40 is pushed by the wall surface 11A as the connection progresses. The movable member 48 is held releasably with the slide cover 40 and is moved back relative to the female housing 20 while resiliently compressing the springs 45. The guiding surface 33 at the front end of the lock arm 30 contacts the guiding surface 16 of the upper lock projection 15 as the connection approaches its final stage: As a result, the front end of the lock arm 30 moves onto the lock projection 15 and the lock arm 30 pivots about the support 31. At this time, the springs 45 are compressed further the longitudinal axes thereof curve (see e.g. FIG. 11).

Figure 12:
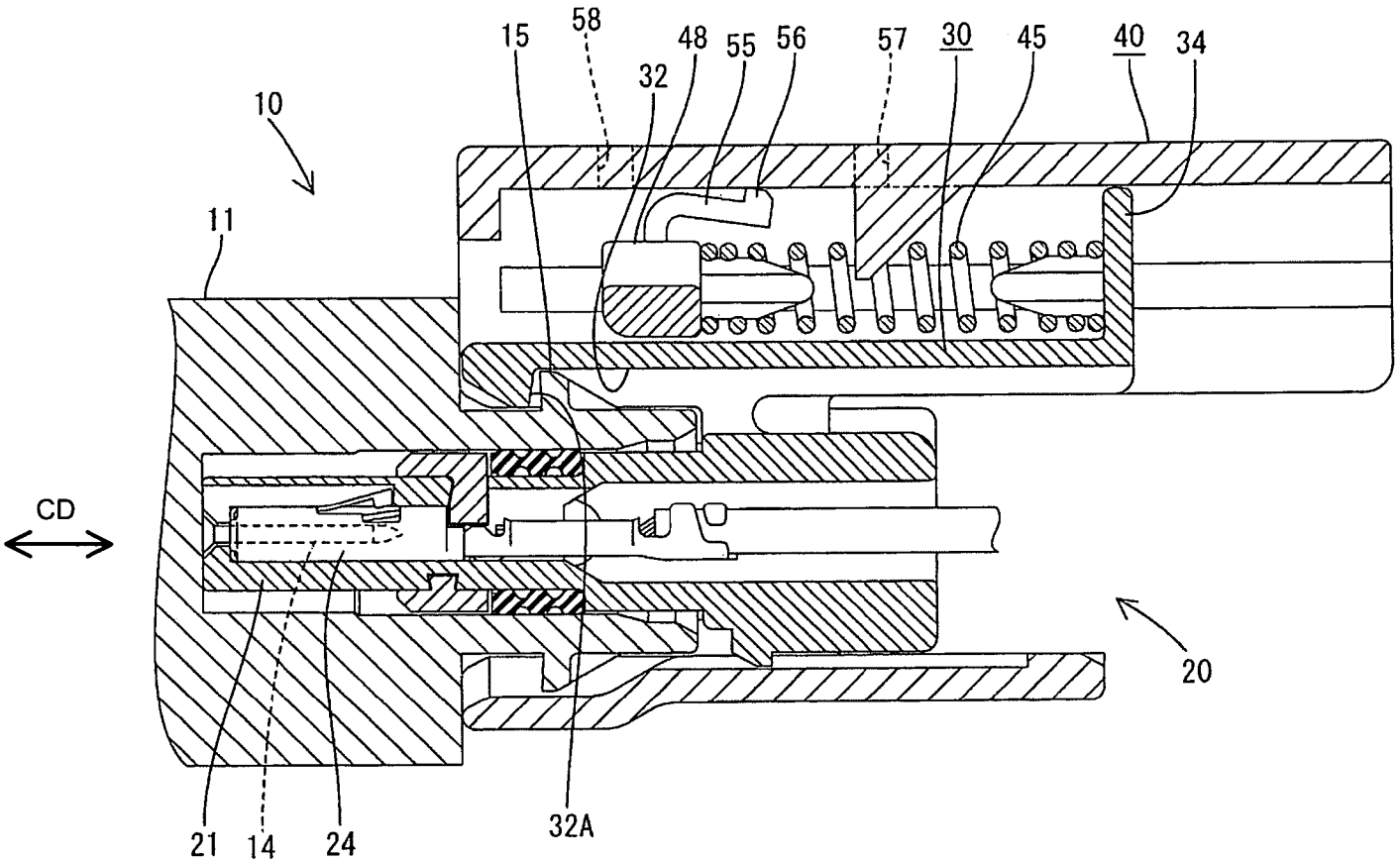
FIG. 12 is a longitudinal section when locking is effected.

The front end of the lock arm 30 passes the upper lock projection 15 when the two housings 10, 20 are connected properly. Thus, the lock arm 30 is restored resiliently so that the lock groove 32 receives the upper lock projection 15, as shown in FIG. 12. The front surface 32A of the lock groove 32 then engages the upper lock projection 15 to lock the two housings 10, 20 in their properly connected state with the male and female terminals 14, 24 connected properly together. Simultaneously, the resilient forces of the springs 45 exceed the specified intensity. As a result, the resilient locks 55 curve sufficiently for the locking sections 56 to exit the first locking holes 57, as shown in FIG. 12. The springs 45 then expand towards their unbiased state and move the movable member 48 forward.

Figure 13:
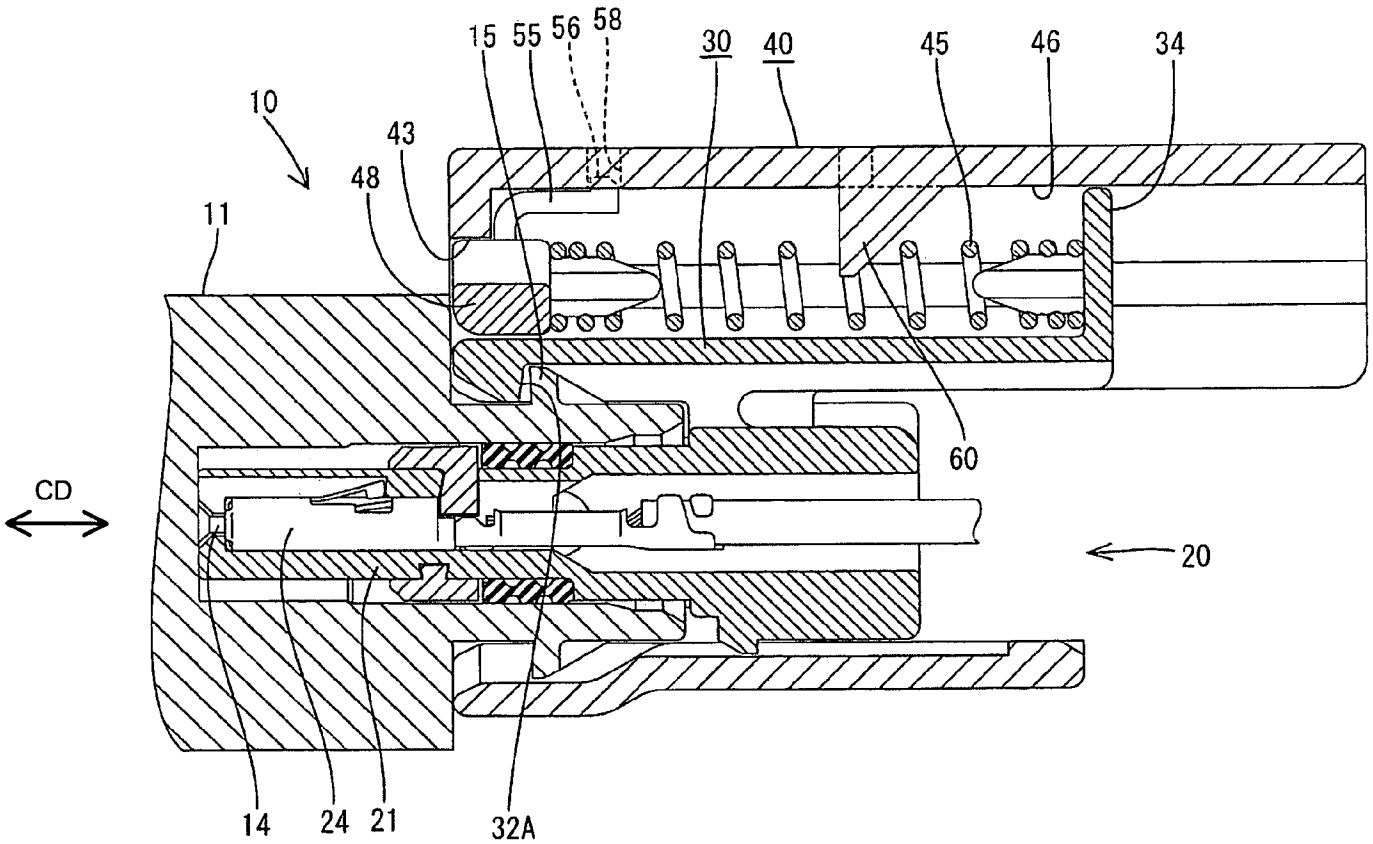
FIG. 13 is a longitudinal section when the male and female housings are locked in their properly connected state.

The movable member 48 is in the window 43 when the springs 45 are returned to their unbiased state. Additionally, the locking sections 56 of the resilient locks 55 fit in the second locking holes 58 to hold the movable member 48, as shown in FIG. 13. In this way, the connecting operation is completed.

The biasing springs 45 return to their unbiased state, and therefore are not set in fatigue. Additionally, the movable member 48 is immediately above the front end of the lock arm 30 to prevent inadvertent pivotal displacement of the lock arm 30 and to achieve a doubly locked state. Further, abnormal noise resulting from loose movements of the springs 45 and the movable member 48 in the accommodating chamber 46 can be prevented.

Figure 11:
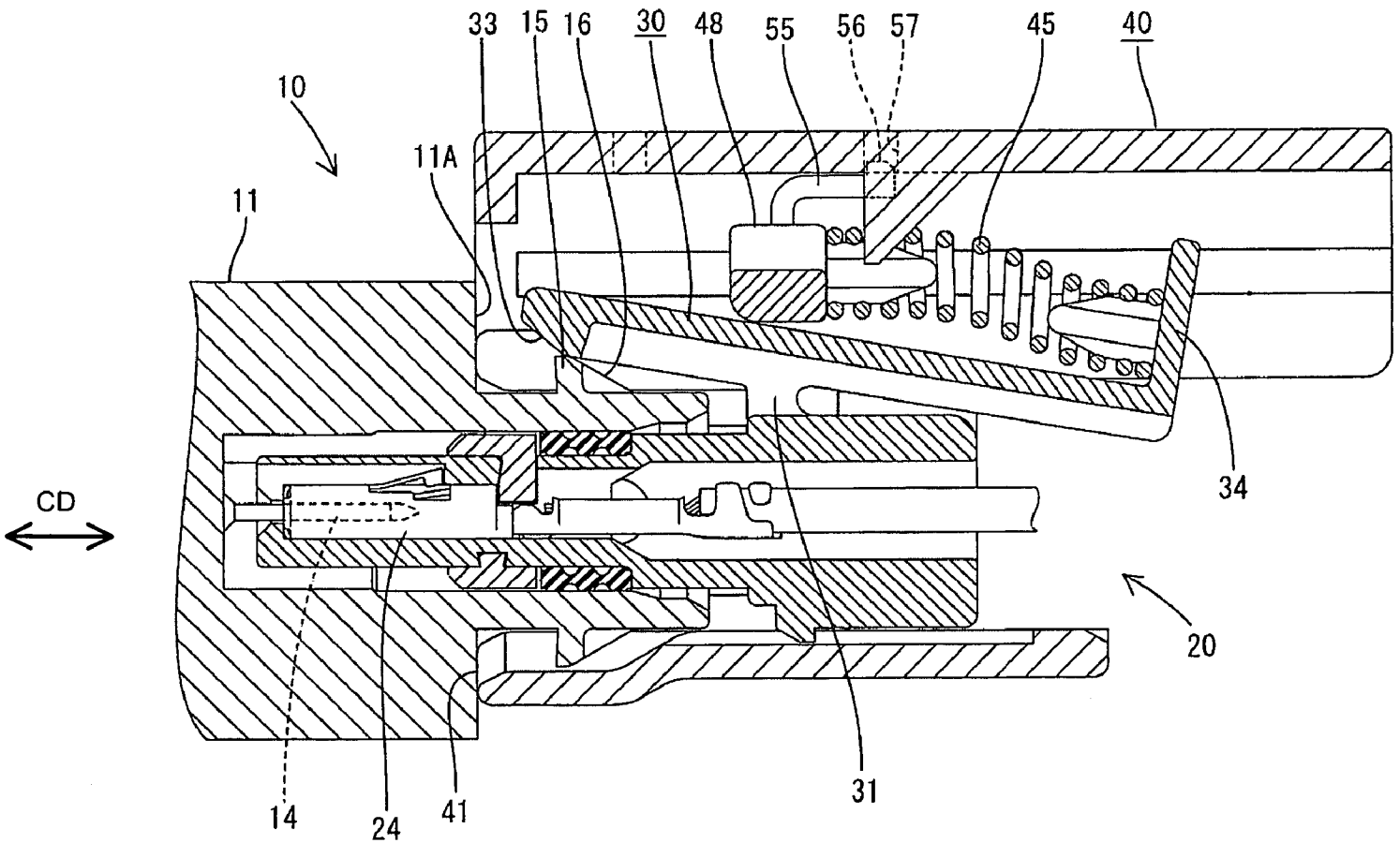
FIG. 11 is a longitudinal section showing a final stage of a connecting operation.

The connecting operation may be stopped approximately in the FIG. 11 state and before the two housings 10, 20 are connected properly. In this event, the resilient forces of the compressed springs 45 push the operable plate 34 of the lock arm 30 and separate the female housing 20 from the male housing 10. In this way, the partly connected condition of two housings 10, 20 is detected and the connecting operation may be carried out again.

Figure 14:
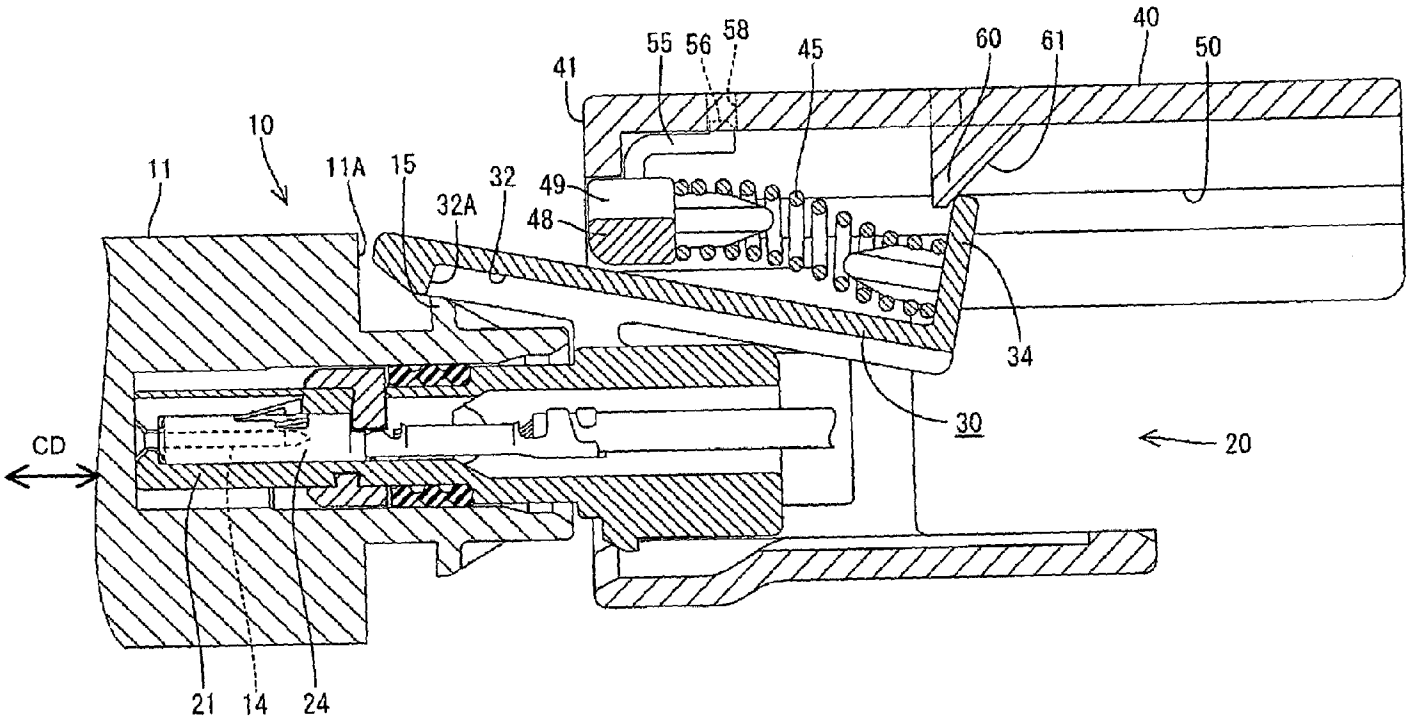
FIG. 14 is a longitudinal section showing a state where unlocking is effected.

The female housing 20 may have to be separated from the male housing 10 for maintenance or other reason. In this case, the slide cover 40 is pulled back from the state shown in FIG. 13. Reward movement of the slide cover 40 compresses the springs 45, and urges the cam surface 61 of the unlocking portion 60 against the operable plate 34 of the lock arm 30. Thus, the operable plate 34 is pressed down, as shown in FIG. 14, and the lock arm 30 pivots sufficiently to disengage the lock groove 32 from the upper lock projection 15 to effect unlocking.

Figure 15:
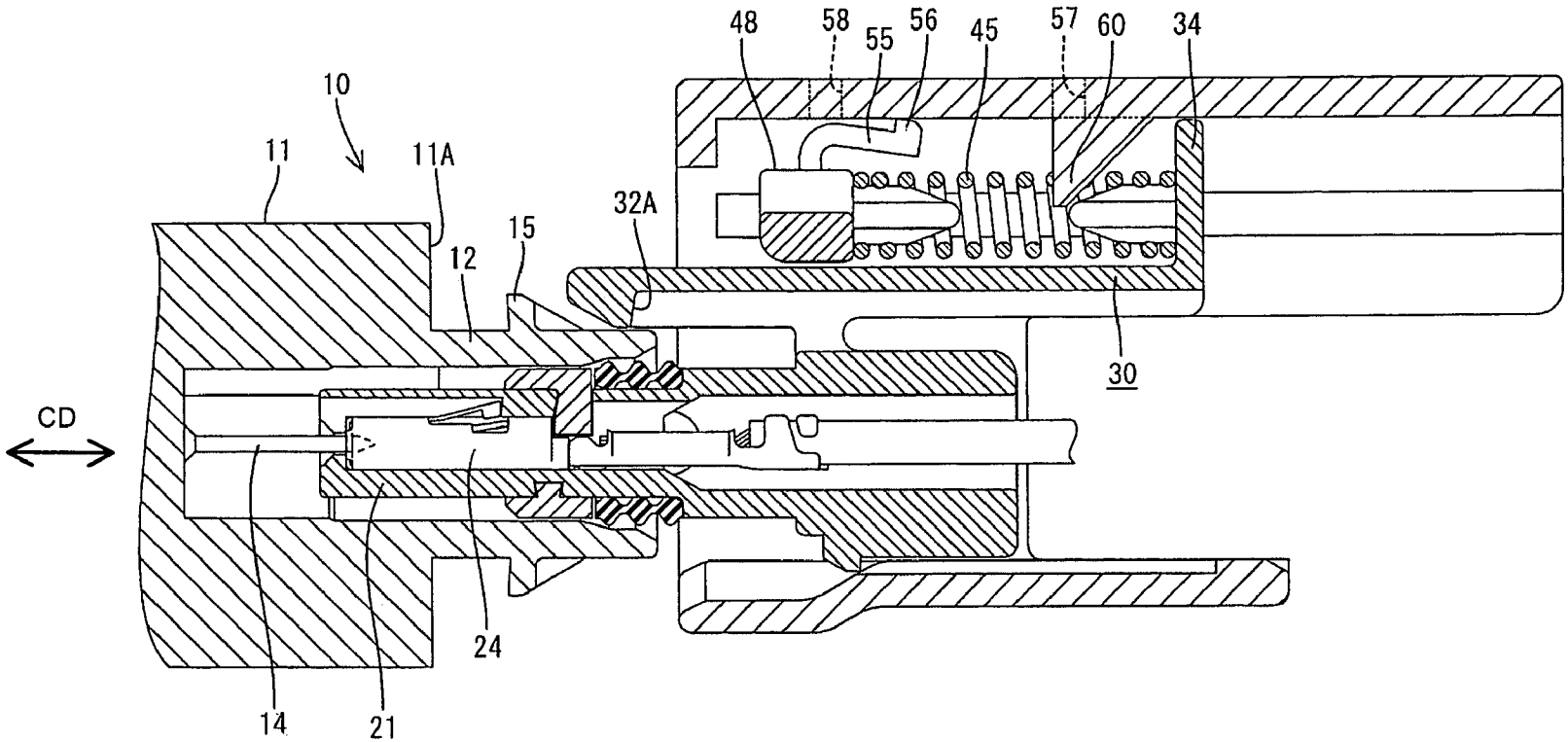
FIG. 15 is a longitudinal section showing a state where the female housing is pulled backward.

The resilient forces of the resiliently compressed springs 45 then push the operable plate 34 of the lock arm 30, and the female housing 20 is pulled back and separated from the male housing 10. During this time, a force also acts to pull the movable member 48 back. As a result, the resilient locks 55 deform sufficiently for the locking sections 56 to exit the second locking holes 58 and the movable member 48 is pulled back, as shown in FIG. 15.

The female housing 20 is returned to the initial state, as shown in FIG. 9. Thus, the springs 45 are unbiased, the locking sections 56 of the resilient locks 55 of the movable member 48 are in the first locking holes 57 and the front plate 41 of the slide cover 40 is flush with the front surface of the terminal accommodating portion 21.

As described above, the front end of the slide cover 40 is extended forward. Thus, the slide cover 40 can be pushed using the wall surface 11A of the apparatus 11, and the springs 45 can be compressed resiliently. Therefore, even if the receptacle 12 has a short length, the partial connection detecting function of the springs 45 is exhibited.

The rear ends of the springs 45 are fixed to the operable plate 34 of the lock arm 30, and the springs 45 are mounted utilizing the pivoting space for the lock arm 30. Thus, a mounting space for the springs 45 is saved to enable a compact female housing 20.

The slide cover 40 is pulled back to separate the two housings 10, 20 for maintenance or other reason. Thus, the springs 45 compress gradually and accumulate resilient forces. Sufficient rearward movement of the slide cover 40 presses the unlocking portion 60 against the operable plate 34 of the lock arm 30 and pivots the lock arm 30 to effect unlocking. The female housing 20 then is urged back from the male housing 10 by the resilient forces of the springs 45. In other words, the two housings 10, 20 can be separated easily by utilizing the biasing forces of the springs 45.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is not limited to applications where a connector is coupled to an apparatus, and may be applied to wire-to-wire connectors.

The above-described pushing portion is behind the lock projections and pushes the slide cover, but need not always be formed on the entire surface extending normal to a connecting direction of the two housings like the wall surface of the apparatus in the foregoing embodiment. For example, the pushing portion may be formed only on a surface passing the lock projections out of surfaces extending in the center of the male housing along the connecting directions of the two housings. In such a case, a dimension of the outer shape of the male housing in a direction normal to the surface passing the lock projections can be made smaller.

Conversely, the pushing portion may be on a surface intersecting the surface passing the lock projections. In such a case, a dimension of the outer shape of the male housing in a direction along the surface passing the lock projections can be made smaller.

The lock projections may be on the female housing, whereas the lock arm, the springs and the slide cover may be in the male housing.

What is claimed is:

1. A connector, comprising:

a housing connectable with a mating housing;

a lock arm on the housing and resiliently engageable with a lock projection on the mating housing;

a slider mounted on the housing for sliding movement along forward and backward directions, the slider having a front end configured for contacting a pushing portion at a position on the mating housing behind the lock projection to push the front end before the lock arm engages the lock projection; and at least one biasing member extendible and compressible substantially along the forward and backward directions, the biasing member having a rear end fixed to the housing and a front end releasably locked to a position on the slider receded from a front end of the slider, and a locked state being releasable by a resilient force acting when the biasing member is compressed to a specified extent.

2. The connector of claim 1, further including locking means for locking the front end of the biasing member to the slider after the biasing member has returned to an unbiased state.

3. The connector of claim 1, wherein the lock arm is substantially seesaw-shaped and has a front end engageable with the lock projection and a rear end disposed to be pressed for pivoting the lock arm and disengaging the lock arm from the lock projection.

4. The connector of claim 3, wherein the rear end of the biasing member is fixed to the rear end of the lock arm.

5. The connector of claim 4, wherein the slider includes an unlocking portion for pressing the rear end of the lock arm to pivotally displace the lock arm and to free the lock projection from the locked state when the slider is moved back by a specified distance with the two housings properly connected with each other.

6. The connector of claim 5, wherein the pushing portion is on a part of a surface passing the center of the housing and extending substantially along a connecting direction of the two housings, which part passes the lock projection.

7. The connector of claim 5, wherein the pushing portion is provided on a part of a surface passing the center of the housing and extending substantially along a connecting direction of the two housings, which part intersects with a surface passing the lock projection.

8. The connector according of claim 1, wherein the slider has an accommodating chamber in which a movable member is movably accommodated, wherein the biasing member has the front end thereof mounted to the movable member.

9. The connector of claim 8, wherein the movable member has locking means for releasable locking to the slider in two spaced apart positions.

10. The connector of claim 1, wherein the biasing member comprises two biasing elements arranged substantially symmetrically with respect to the slider.

11. A connector assembly, comprising:

a first housing having a front end, a pushing portion spaced rearward from the front end and a lock projection between the front end and the pushing portion;

a second housing connectable with the first housing, a resiliently deflectable lock arm formed on the second housing, the lock arm having a front end configured for engaging with the lock projection on the first housing and an opposite rear end;

a slider mounted on the second housing for sliding movement along forward and backward directions, the slider having a front end configured and disposed for contacting the pushing portion on the first housing before the lock arm engages the lock projection; and at least one biasing member extendible and compressible substantially along the forward and backward directions, the biasing member having a rear end fixed to the rear end of the lock arm and a front end releasably locked to a position on the slider receded from a front end of the slider, the front end of the biasing member being releasable from the slider in response to a resilient force acting when the biasing member is compressed to a specified extent.

12. The connector of claim 11, wherein the lock arm is substantially seesaw-shaped and is resiliently deflectable about a support between the front and rear ends of the lock arm.

13. The connector of claim 12, wherein the slider includes an unlocking portion for pressing the rear end of the lock arm to pivotally displace the lock arm and to free the lock projection from the locked state when the slider is moved back by a specified distance with the two housings properly connected with each other.

14. The connector according of claim 11, wherein the slider has an accommodating chamber in which a movable member is movably accommodated, wherein the biasing member has the front end thereof mounted to the movable member.

15. The connector of claim 14, wherein the movable member has locking means for releasable locking to the slider in two spaced apart positions.

* * * * *